United States Patent [19]

Grass

[11] 3,976,346

[45] Aug. 24, 1976

[54] GUIDE RAILS FOR DRAWERS

[76] Inventor: Alfred Grass, Konsumstrasse 492, A-6973 Hochst, Vlbg., Austria

[22] Filed: Apr. 25, 1975

[21] Appl. No.: 571,767

[30] Foreign Application Priority Data

Apr. 25, 1974 Austria ..... 3447/74

[52] U.S. Cl. ..... 312/350; 312/345

[51] Int. Cl.[2] ..... A47B 88/04; F16C 32/00

[58] Field of Search ..... 308/3.6, 3.8; 312/350, 312/345, 342

[56] References Cited

UNITED STATES PATENTS 3,677,615 7/1972 Hudson ..... 308/3.6

FOREIGN PATENTS OR APPLICATIONS 604,945 5/1960 Italy ..... 308/3.8

*Primary Examiner*—Casmir A. Nunberg

*Attorney, Agent, or Firm*—Sherman Levy

[57] ABSTRACT

The invention relates to a guide rail for drawers in which the rail is formed with lugs engaging grooves in the side walls of the drawers frame into which the lugs are introduced by a rotary motion of a tool for anchorage purposes.

3 Claims, 5 Drawing Figures

Fig. 1
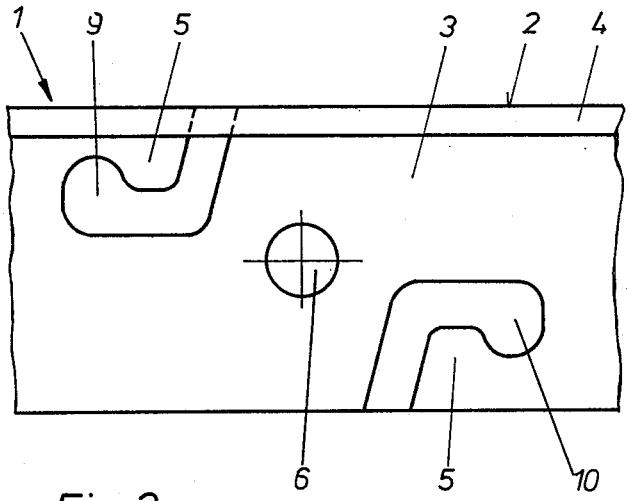
Fig. 2
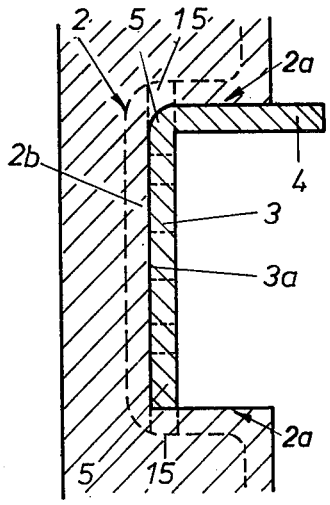
Fig. 3
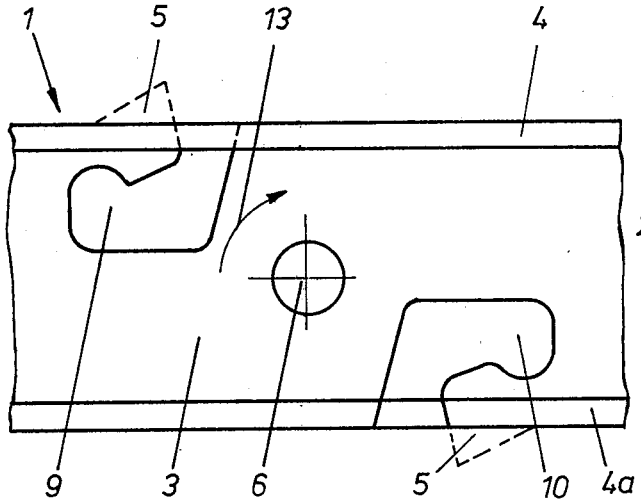
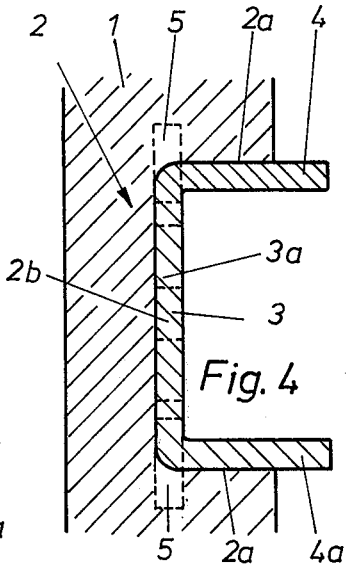
Fig. 4
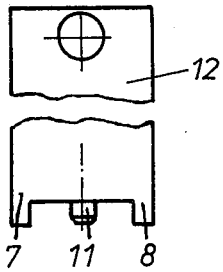
Fig. 5

GUIDE RAILS FOR DRAWERS

The invention relates to improvements in guide rails for drawers which are mounted in a groove of a side wall of a drawer by means of lugs made of the material of the guide rail and inserted by a tool.

Such guide rails which may be formed U-shaped and angularly serve to guide the drawer on the body of the article of furniture in a sliding manner by means of guide rails fixed on the body or by roller bearings fixed on the body or rollers or balls guided in separate rails.

For receiving the guide rails the drawer has on each side a groove in which the guide rail is fixed. Hitherto this fixing has been effected by arranging the guide rail in the groove or by suspending the rail provided with hooks, in a hollow chamber section of the groove. In the simplest form the guide rail consisted of a simple wooden strip inserted and fixed in the groove.

These arrangements however are completely satisfactory. The use of a simple wooden strip leads to difficult accessibility and jamming of the drawer. In addition the load capacity is low. The mounting of the guide rail in the groove is associated with considerable expenditure of labour and time and is accordingly costly. The same applies for the suspension of the rail by means of hooks.

This arrangement provides in addition firm seating of the rail in question whereby the easy accessibility and load capacity of the drawer may be endangered. German Patent Specification 444685 proposes a method for the fixing of metal fittings in wood in particular sleeves in which, nose pieces are pressed into the wood by special spincers.

The problem of the German Patent Specification No. 444685 differ from the problem of the present invention, The sleeves fixed by the above mentioned method have lugs in the side wall of the sleeve which lugs for fixing on the wood are spread out with a tool and thereby penetrate into the wood. The drawback of this arrangement is that the wall of the sleeve is deformed in the region of the lug and such a sleeve cannot be used as a guide rail as the guide means of the drawer in the wall of the sleeve designed as a guide rail require a flat uninterrupted face in order to ensure a smooth running of the drawer.

The invention is thus based on the problem of providing a guide rail with smooth uninterrupted side walls for receiving the guide means of the drawer whereby this guide rail is fixable rapidly and easily on the side wall of the drawer.

The invention is furthermore based on the problem of providing a guide rail for drawers of the type described which is easily made and mounted in order to reduce the manufacturing costs and which in addition has a fixed and thus highly loaded seating in the groove in the side wall of the drawer.

The solution of this problem consists in that the guide rail has on its face contacting the bottom of the groove which has lugs which are capable of being pressed into the side walls of the groove by deformation parallel to the bottom of the groove.

Such guide rails formed according to the invention are easily made as the lugs may be formed by simply shaped stamped out portions in the face of the guide rail. Furthermore they are fixed securely in the grooves as the pressing of the lugs provides a secure locking which is in a position to transmit also large forces. In addition the mounting is very simple since for the deforming of the lugs a very small expenditure of time is necessary.

This expenditure of time may be still further reduced in that the lugs are deformed with the aid of a tool.

The tool is suitably formed such that it has projections bending the lugs and if necessary has a centering pin which is guided in a slot in the face of the guide rail.

These measures ensure that the tool can be applied accurately and without great effort work and the lugs are deformed uniformly.

The guide rails according to the invention have furthermore the advantage that they can be fixed on drawers of relatively thin-walled cross-section as the lugs are pressed into the side walls of the groove only parallel to the bottom of the grooves and therefore the width required for this fixing is not greater than the width of the lugs themselves.

With the use of drawers made of sheet metal or plastics the side walls of which have a constant wall thickness and in which therefore the groove is formed projecting inwards it is advisable that the side walls of the grooves should have recesses for receiving the deformed lugs. By bending the lugs into these recesses comparatively small deformation forces are required without the quality of the fixing suffering.

With guide rails having two supporting faces, that is, therefore U-shaped profile it is advisable to arrange the lugs diametrically opposite so that deformation is in a single operation with a suitable tool to deform at the same time two diametrically opposite lugs. With such a construction of U-shaped profile it is particularly conventient to arrange centrally between the lugs the opening for the centering pin of a tool so that the simultaneous and uniform deformation of the two lugs in one working procedure is ensured.

The invention will be described with reference to the accompanying drawings:

FIG. 1 shows a guide rail placed in the groove of a drawer before the deformation of the lugs;

FIG. 2 shows a cross-section of FIG. 1;

FIG. 3 shows a guide rail fixed in a groove of the drawer by deformation of the lugs;

FIG. 4 shows a cross-section of FIG. 3; and

FIG. 5 shows a tool for the deformation of the lugs.

A drawer 1 has the groove 2 in the side walls which grooves has side walls 2*a* and the bottom of the groove 2*b*. The guide rail 3 is inserted in the grooves and is formed with an angular profile in FIGS. 1 and 2 with a face 3*a* and the lug 4.

After the insertion, the tool 12 (FIG. 5) with a pin 11 is inserted in the bore 6 in the face 3*a* of the rail 3 to press the projections 7 and 8 into the slots 9 and 10 to form the fixing lugs 5. By turning the tool 12 in the direction of the arrow 13 (FIG. 3) for the purpose of fixing, the lugs are bent outwards and thereby penetrate into the side walls 2*a* of the groove 2 thereby firmly locking the rail 3 to provide a secure and highly stressed anchorage. In producing this anchorage a smaller cross-section of the drawer 1 is required as the width for the fixing the rail 3 is not greater than the width of the lugs 5.

The invention is not limited to the embodiment shown. The steel material preferably used in the embodiment may also be a plastics material of suitable strength. Lugs formed on such plastics may easily penetrate into the side walls 2*a* of the groove 2 in the drawer when the material of the drawer is, for example, a chip board.

The material of the drawer may however also be steel or plastic with constant wall thickness in which case the groove is formed inwards in the drawer as shown in broken lines 14 in FIG. 2.

What I claim is:

1. A guide rail for drawers having a frame of the kind in which the rail is mounted in a groove in the side walls of the drawer frame by lugs expanded thereinto comprising a guide rail, lugs on the face of the rail engaging grooves in the side walls by deformation of the lugs in a direction parallel to the bottom of the groove.

2. A guide rail according to claim 1 with two supporting faces, characterised in that the lugs (5) lie in a position diametrically opposite one another.

3. A guide rail according to claim 2, characterised in that the opening (6) for a centering pin (11) of a tool (12) is arranged centrally between said lugs (5).

* * * * *